US007919736B2

(12) United States Patent
Ikeda et al.

(10) Patent No.: US 7,919,736 B2
(45) Date of Patent: Apr. 5, 2011

(54) HEATING DEVICE

(75) Inventors: Toshihisa Ikeda, Kyoto (JP); Kiyoshi Kanazawa, Osaka (JP)

(73) Assignee: Panasonic Corporation, Osaka (JP)

( * ) Notice: Subject to any disclaimer, the term of this patent is extended or adjusted under 35 U.S.C. 154(b) by 370 days.

(21) Appl. No.: 11/577,635

(22) PCT Filed: Jul. 27, 2005

(86) PCT No.: PCT/JP2005/013727

§ 371 (c)(1),
(2), (4) Date: Apr. 20, 2007

(87) PCT Pub. No.: WO2006/048964

PCT Pub. Date: May 11, 2006

(65) Prior Publication Data

US 2008/0105673 A1 May 8, 2008

(30) Foreign Application Priority Data

Nov. 2, 2004 (JP) ..... 2004-318978
Nov. 2, 2004 (JP) ..... 2004-318979
Dec. 13, 2004 (JP) ..... 2004-359427

(51) Int. Cl.
*H05B 6/50* (2006.01)
*H05B 6/66* (2006.01)

(52) U.S. Cl. ..... 219/714; 219/702; 219/713

(58) Field of Classification Search ..... 219/710, 219/713, 729, 741, 743, 748, 737, 738, 714, 219/736, 734, 716, 711
See application file for complete search history.

(56) References Cited

U.S. PATENT DOCUMENTS 5,724,244 A * 3/1998 Yabuki ..... 705/400
5,824,999 A * 10/1998 Kim et al. ..... 219/742
6,124,583 A 9/2000 Bowers
6,892,545 B2 5/2005 Ishikawa et al.
2002/0059175 A1 5/2002 Nakano
2002/0157411 A1 * 10/2002 Ishikawa et al. ..... 62/231

FOREIGN PATENT DOCUMENTS

EP 1 172 752 A2 1/2002
EP 1 174 667 A1 1/2002
EP 1 193 584 A1 4/2002
GB 2 300 053 A 10/1996

(Continued)

OTHER PUBLICATIONS

International Search Report for Application No. PCT/JP2005/013727 dated Oct. 25, 2005.

(Continued)

*Primary Examiner* — Quang T Van
*Assistant Examiner* — Hung Nguyen
(74) *Attorney, Agent, or Firm* — RatnerPrestia

(57) ABSTRACT

A heating device includes a main body with an opening, a magnetron for generating electromagnetic waves for heating, a door for putting in and taking out an object to be heated, a reader, and a barrier. The magnetron emits electromagnetic waves into the main body. The door covers the opening of the main body. The reader reads information contained in a wireless IC tag attached to the object to be heated. The barrier acts a shield for the reader from the electromagnetic waves emitted by the magnetron when the door is closed, and the shield is broken when the door is opened.

12 Claims, 10 Drawing Sheets

FOREIGN PATENT DOCUMENTS

| | | |
|---|---|---|
| JP | 64-041002 | 3/1989 |
| JP | 08-291914 | 11/1996 |
| JP | 09-180876 | 7/1997 |
| JP | 11-230554 | 8/1999 |
| JP | 11-276359 | 10/1999 |
| JP | 2001-267060 | 9/2001 |
| JP | 2001-317741 | 11/2001 |
| JP | 2001-349546 | 12/2001 |
| JP | 2002-022177 | 1/2002 |
| JP | 2002-196672 | 7/2002 |
| JP | 2003-006599 A | 1/2003 |
| JP | 2003-500621 | 1/2003 |
| JP | 2005-129038 | 5/2005 |
| WO | WO 00/71010 A1 | 11/2000 |

OTHER PUBLICATIONS

Supplementary European Search Report for Application No. EP 05 76 7150, Oct. 14, 2010, Panasonic Corporation.

* cited by examiner

HEATING DEVICE

This application is a U.S. national phase application of PCT international patent application No. PCT/JP2005/013727.

TECHNICAL FIELD

The present invention relates to heating devices such as microwave ovens used for cooking.

BACKGROUND ART

Application of technology for noncontact information communications that involves writing information in wireless IC tags (hereinafter "IC tags") and reading it out has been increasing. As a part of this trend, attaching IC tags, which contain information on content and cooking methods or the like, to food containers or packages is being studied. One example of a heating device that cooks food under optimal conditions after reading the information in these IC tags is disclosed in Japanese Patent Unexamined Publication No. 2001-317741. This heating device has a reader for reading information in the IC tag. However, the reader has a high risk of being destroyed if it is exposed to strong electromagnetic waves used for heating.

SUMMARY OF THE INVENTION

A heating device of the present invention includes a main body provided with an opening, a magnetron configured to generate electromagnetic waves for heating, a door configured to put in and taking out an object to be heated, a reader, and a barrier. The magnetron emits electromagnetic waves into the main body. The door covers the opening of the main body. The reader reads information contained in a wireless IC tag attached to the object to be heated. The barrier acts as a shield for the reader from the electromagnetic waves emitted by the magnetron when the door is closed, and breaks the shield for the reader when the door is opened. This structure avoids problems of destroying the reader by strong electromagnetic waves for heating.

DETAILED DESCRIPTION OF PREFERRED EMBODIMENTS

First Exemplary Embodiment

Figure 1:
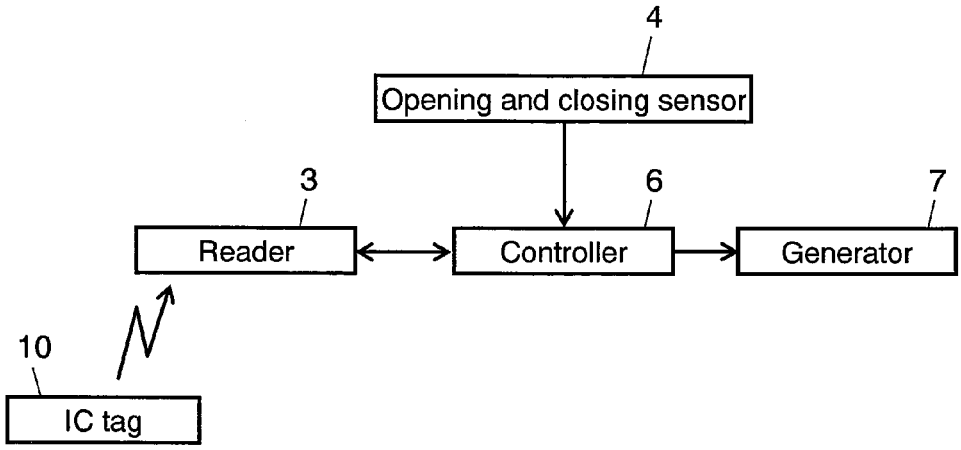
FIG. 1 is a functional block diagram of a microwave oven in accordance with exemplary embodiments of the present invention.
Figure 2:
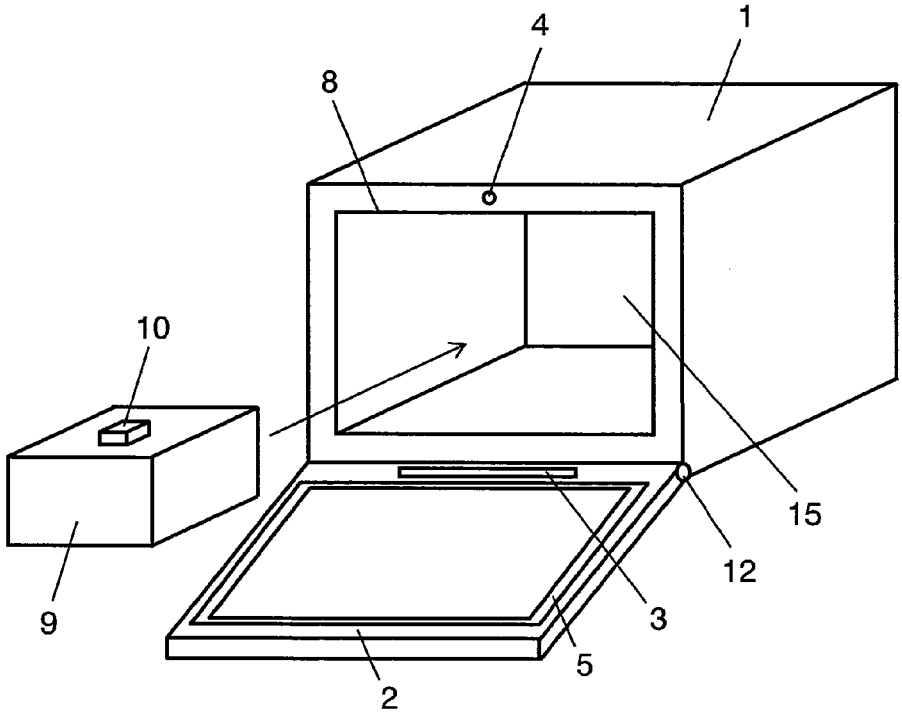
FIG. 2 is a perspective view of the microwave oven in accordance with the first exemplary embodiment of the present invention.
Figure 3:
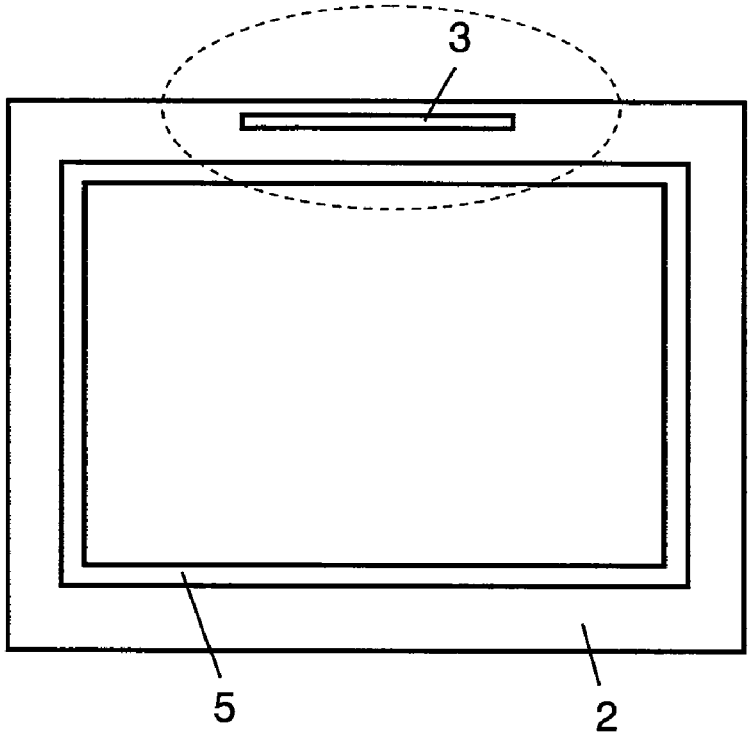
FIG. 3 is a plan view of a door structure of the microwave oven shown in FIG. 2.

FIG. 1 is a functional block diagram of a structure of a microwave oven which is a heating device in the first exemplary embodiment of the present invention. FIG. 2 is a perspective view of a structure of the microwave oven in the first exemplary embodiment of the present invention, and FIG. 3 is a plan view of a door structure.

Main body 1 is provided with opening 8, and door 2 is attached to main body 1 via joint 12 for covering opening 8. Joint 12 is provided along one side of door 2, and thus door 2 is coupled to main body 1 in an openable and closable fashion. Magnetron 7, which generates electromagnetic waves for heating, is built into main body 1 so as to emit electromagnetic waves to cooking space 15 in main body 1. The user opens door 2 and inserts object 9 to be heated for cooking, such as food, from opening 8 into cooking space 15. Wireless IC tag (hereinafter "IC tag") 10 is attached to object 9 to be heated.

Reader 3 configured to read information contained in IC tag 10 is provided on a periphery of door 2. In other words, the periphery of door 2 is a placement area for reader 3. Barrier 5 is provided on the periphery of door 2 at an inner side of reader 3. Controller 6 controls the turning on and off of magnetron 7, magnitude of output power, operation time, and so on based on information read by reader 3. Controller 6 also receives a detection result of opening and closing sensor (hereinafter "sensor") 4 provided near opening 8.

Main body 1 and door 2 are made of metal such as stainless steel or painted sheet steel. Joint 12 is configured with mechanical components such as a hinge. Magnetron 7 includes a magnetron that generates electromagnetic waves typically at the frequency of 2.45 GHz.

IC tag 10 is configured with an IC chip and an antenna connected to the IC chip. IC tag 10 does not contain any power source such as a battery, since the power is supplied from electric waves generated by reader 3 when IC tag 10 enters an electric wave area of reader 3. The antenna is configured, for example, by attaching a copper foil to a thin resin sheet such as an acrylic sheet. ROM or nonvolatile RAM is used for the IC chip. Since electric waves from reader 3 contain a command, IC tag 10 returns data, including an individual ID, from its antenna to reader 3 in response to the command. When IC tag 10 is used for the microwave oven as in this exemplary embodiment, information on cooking methods such as heating time and heating power of electromagnetic waves is written in the IC chip in advance. IC tag 10 transmits these pieces of information together with the individual ID.

Reader 3 is configured with an antenna and processing circuits such as an RF unit, an RF controller, and a host interface. The RF unit is a communicating circuit for sending and receiving electric waves to and from IC tag 10. There are a wide variety of general wireless IC tag readers for short to long communication ranges which are determined by transmission power and antenna size. For the purpose of this exemplary embodiment, wireless IC tag readers for a communication range of several centimeters to several tens of centimeters are suitable.

Reader 3 may be configured only with the antenna, and a separate processing circuit can be provided independently. In FIGS. 2 and 3, the antenna of reader 3 is straight, but it may also be C-shaped, L-shaped, or squared along the periphery of door 2. One example of IC tag 10 and reader 3 is disclosed in Japanese Patent Unexamined Publication No. 2001-317741.

Barrier 5 has a choke structure in which a choke hollow is formed in a clearance between door 2 and main body 1 by bending a metal sheet such as stainless steel. Alternately, barrier 5 may have a structure of a metal protrusion, and a groove that receives this protrusion is formed around opening 8 of main body 1. Still another, a material with small voids, such as sponge metal and metal wool, may be used for barrier 5. If the frequency of electromagnetic waves from magnetron 7 is 2.45 GHz, voids of 1.4 mm or smaller are acceptable. Barrier 5, which has one of the above structures, shields reader 3 from electromagnetic waves for heating emitted by magnetron 7. There is no restriction in a type of metal used for barrier 5.

Sensor 4 is typically configured with a push switch, a combination of a lamp and an infrared ray sensor, or the like. Controller 6 may be configured with dedicated hardware or a general microcomputer in which control software is installed.

The operation of the microwave oven as configured above for cooking object 9 is described next. First, a user opens door 2 and inserts object 9 to be heated from opening 8 into cooking space 15. At this point, reader 3 reads information written in IC tag 10 and sends it to controller 6. Since barrier 5 is provided on the periphery of door 2 at the inner side of reader 3, the shield for reader 3 is broken when door 2 is opened. Accordingly, barrier 5 does not disturb reader 3 while reader 3 is reading information contained in IC tag 10. Controller 6 sets heating conditions of magnetron 7 based on this information. When controller 6 detects that door 2 is closed, based on the output from sensor 4, controller 6 starts heating object 9 to be heated in accordance with set heating conditions.

In this state, barrier 5 is provided on the periphery of door 2 at the inner side of reader 3. Accordingly, barrier 5 shields reader 3 from electromagnetic waves emitted by magnetron 7 when door 2 is closed. The strong electromagnetic waves used for cooking thus do not reach the outside of barrier 5 when door 2 is closed. In this way, barrier 5 prevents destruction of reader 3.

In general microwave ovens, punched metal is embedded in the window provided in door 2 to prevent leakage of electromagnetic waves outside while permitting visibility of the window. A choke structure is formed around the window so as to prevent leakage of electromagnetic waves to the outside. This structure is, for example, disclosed in Japanese Patent Unexamined Publication No. 2001-267060. Accordingly, the structure shown in FIGS. 2 and 3 is achieved by providing reader 3 outside this choke structure in the structure of general microwave ovens. If barrier 5 is provided separately from this choke structure, there is no need to provide barrier 5 on the entire circumference of door 2, as in the case shown in FIG. 3, as long as barrier 5 is provided at least between opening 8 and reader 3 when door 2 is closed.

Figure 4:
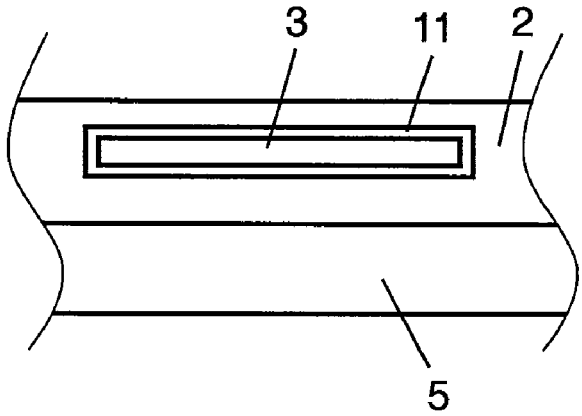
FIG. 4 is an enlarged view around a reader indicated by a dotted line in FIG. 3.

If reader 3 is installed on door 2, the placement area is often made of metal. In general, metal significantly degrades the performance of reader 3. Accordingly, as shown in FIG. 4, attachment 11 made of a material that does not affect communication between reader 3 and IC tag 10 is preferably provided between reader 3 and door 2 where reader 3 is attached. Attachment 11 is typically configured with resin such as epoxy and polyurethane, or ceramic. A favorable effect on electromagnetic wave communication can be expected by interposing attachment 11 between a metal component and reader 3. This reduces the effect of the door, generally made of metal, ensuring more reliable operation of reader 3. In other words, when door 2 which is the placement area for reader 3 is made of metal, attachment 11 is provided between reader 3 and the placement area so as to prevent this placement area from disturbing communication between reader 3 and IC tag 10. In the same way, when the placement area for reader 3 is around opening 8 of main body 1 when reader 3 is disposed on main body 1, which is detailed later, attachment 11 is also preferably provided between main body 1 made of metal and reader 3.

In FIGS. 2 and 3, reader 3 and barrier 5 are disposed on door 2. However, they are not limited to these positions, as long as reader 3 is disposed at a position shielded by barrier 5 from exposure to electromagnetic waves used for cooking. Other positions for reader 3 and barrier 5 are described hereinafter.

Figure 5:
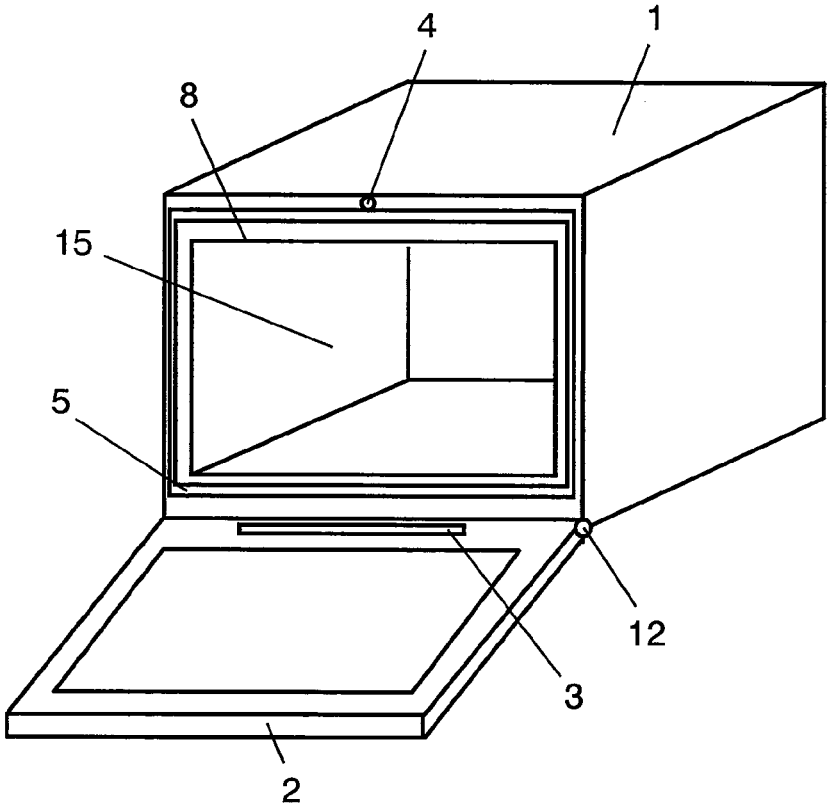
FIG. 5 is a perspective view of another structure of a microwave oven in the first exemplary embodiment of the present invention.
Figure 6:
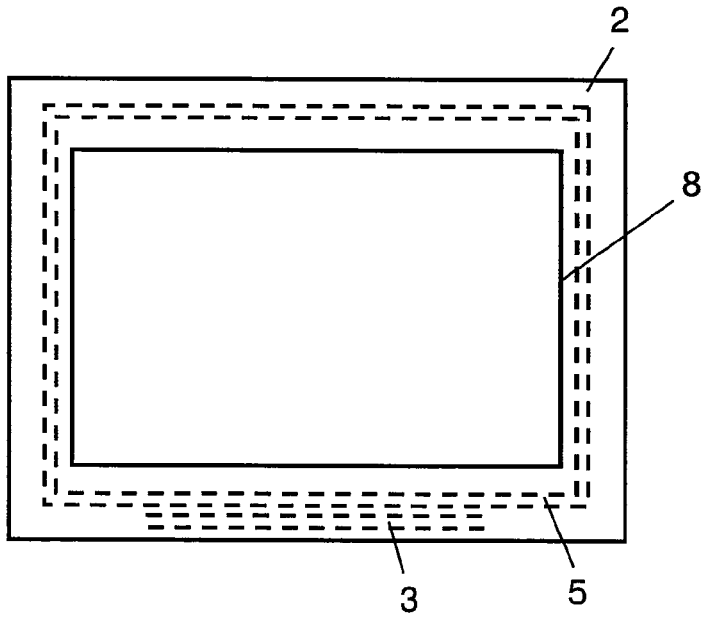
FIG. 6 is a perspective plan view of a structure around a door and an opening in a main body of the microwave oven shown in FIG. 5.

FIG. 5 is a perspective view of another structure of a microwave oven in this exemplary embodiment. FIG. 6 is a perspective plan view of a structure around a door and an opening of the microwave oven shown in FIG. 5 when the door is closed.

The structure shown in FIGS. 5 and 6 differs from that shown in FIGS. 2 and 3 with respect to the position of barrier 5. More specifically, reader 3 is provided on the periphery of door 2, and barrier 5 is provided around opening 8 of main body 1 at a position which becomes the inner side of reader 3 when door 2 is closed. Also with this structure, barrier 5 shields reader 3 from electromagnetic waves emitted by magnetron 7 when door 2 is closed, and the shield for reader 3 is broken when door 2 is opened. Barrier 5 is preferably provided surrounding opening 8, as shown in FIGS. 5 and 6. This structure prevents electromagnetic waves emitted by magnetron 7 from reaching around reader 3.

Figure 7:
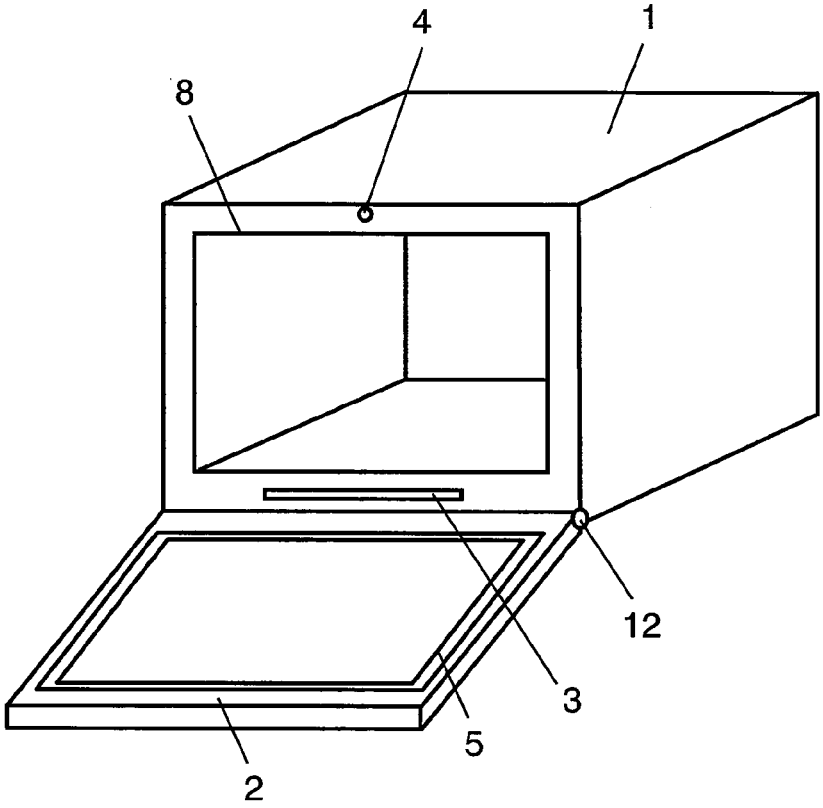
FIG. 7 is a perspective view of still another structure of a microwave oven in the first exemplary embodiment of the present invention.
Figure 8:
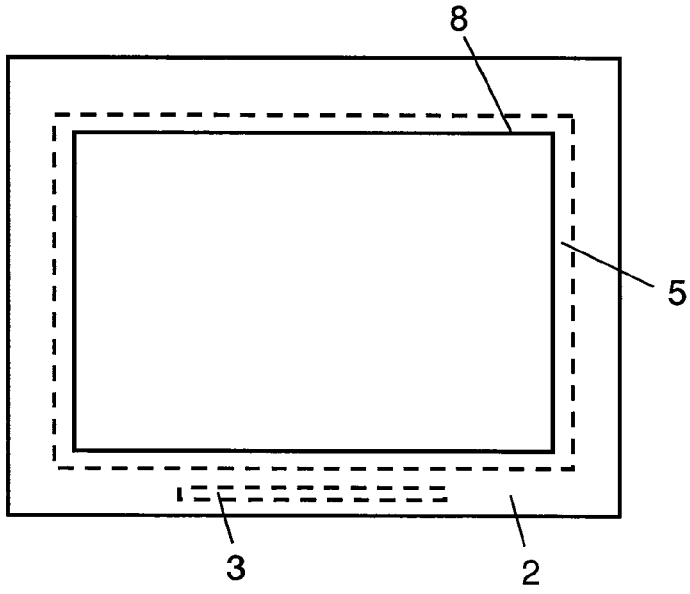
FIG. 8 is a perspective plan view of a structure around a door and an opening of a main body of the microwave oven shown in FIG. 7.

FIG. 7 is a perspective view of still another structure of a microwave oven in this exemplary embodiment. FIG. 8 is a perspective plan view of a structure around a door and an opening of the microwave oven shown in FIG. 7 when the door is closed.

The structure shown in FIGS. 7 and 8 differs from that shown in FIGS. 2 and 3 with respect to the position of reader 3. More specifically, reader 3 is provided around opening 8 of main body 1. Barrier 5 is provided on the periphery of door 2 at a position which becomes the inner side of reader 3 when door 2 is closed. In other words, an area around opening 8 is the placement area for reader 3 in this structure. Also with this structure, barrier 5 shields reader 3 from electromagnetic waves emitted by magnetron 7 when door 2 is closed, and the shield for reader 3 is broken when door 2 is opened.

Figure 9:
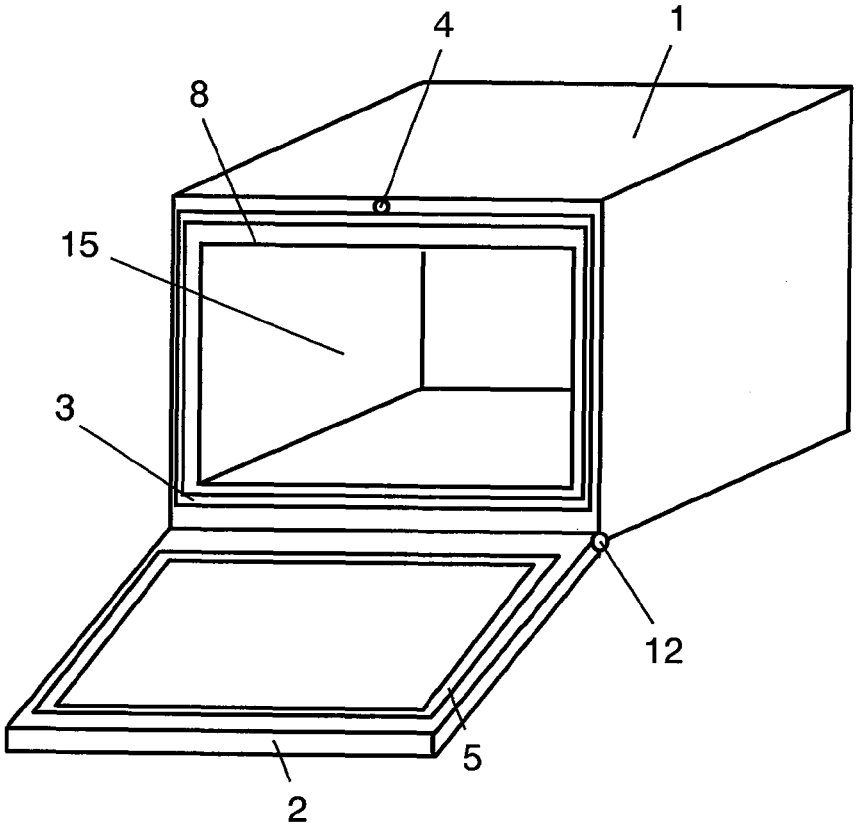
FIG. 9 is a perspective view of still another structure of a microwave oven in the first exemplary embodiment of the present invention.
Figure 10:
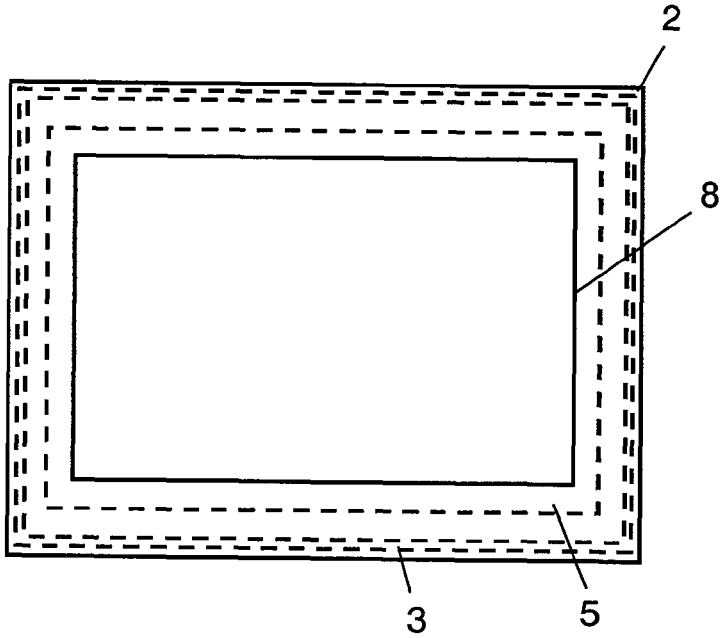
FIG. 10 is a perspective plan view of a structure around a door and an opening of a main body of the microwave oven shown in FIG. 9.

FIG. 9 is a perspective view of still another structure of a microwave oven in this exemplary embodiment. FIG. 10 is a perspective plan view of a structure around a door and an opening of the microwave oven shown in FIG. 9 when the door is closed.

The structure shown in FIGS. 9 and 10 differs from that shown in FIGS. 7 and 8 with respect to the shape of reader 3. More specifically, reader 3 is provided surrounding opening 8 of main body 1. Barrier 5 is provided on the periphery of door 2 at a position which becomes the inner side of reader 3 when door 2 is closed. Also with this structure, barrier 5 shields reader 3 from electromagnetic waves emitted by magnetron 7 when door 2 is closed, and the shield for reader 3 is broken when door 2 is opened. In addition, since reader 3 surrounds opening 8, reader 3 can reliably read information in IC tag 10 even though object 9 to be heated is inserted into main body 1 from any position.

Figure 11:
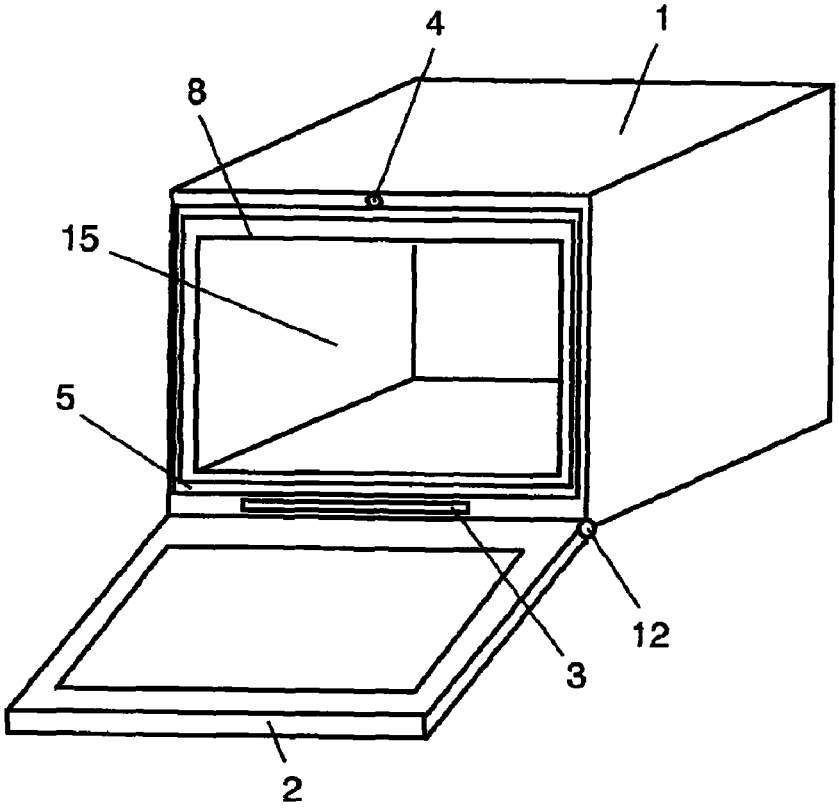
FIG. 11 is a perspective view of still another structure of a microwave oven in the first exemplary embodiment of the present invention.
Figure 12:
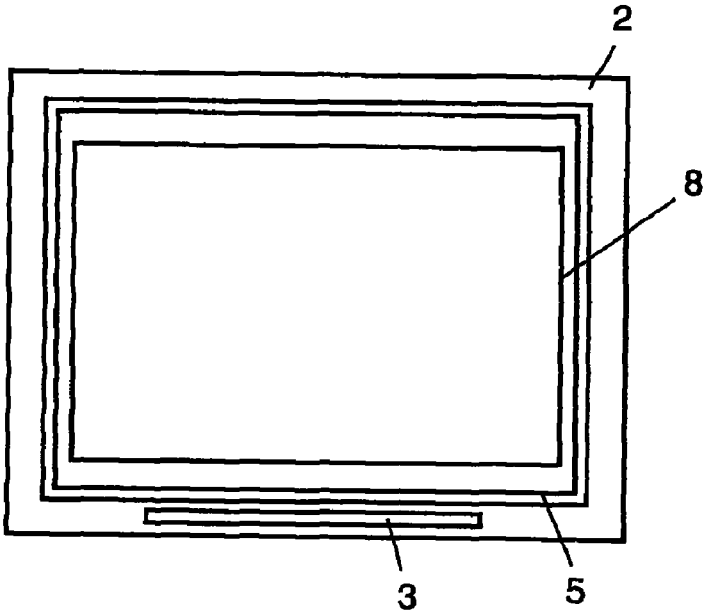
FIG. 12 is a plan view of a structure around a door and an opening of a main body of the microwave oven shown in FIG. 11.

FIG. 11 is a perspective view of still another structure of a microwave oven in this exemplary embodiment. FIG. 12 is a plan view of a structure of an opening of the microwave oven shown in FIG. 11.

The structure shown in FIGS. 11 and 12 differs from that shown in FIGS. 2 and 3 with respect to the positions of reader 3 and barrier 5. More specifically, reader 3 is provided around opening 8 of main body 1, and barrier 5 is provided around opening 8 at the inner side of reader 3. Also with this structure, barrier 5 shields reader 3 from electromagnetic waves emitted by magnetron 7 when door 2 is closed, and the shield for reader 3 is broken when door 2 is opened. Reader 3 may also be provided surrounding opening 8 of main body 1 in the same way as the structure shown in FIGS. 9 and 10.

Figure 13:
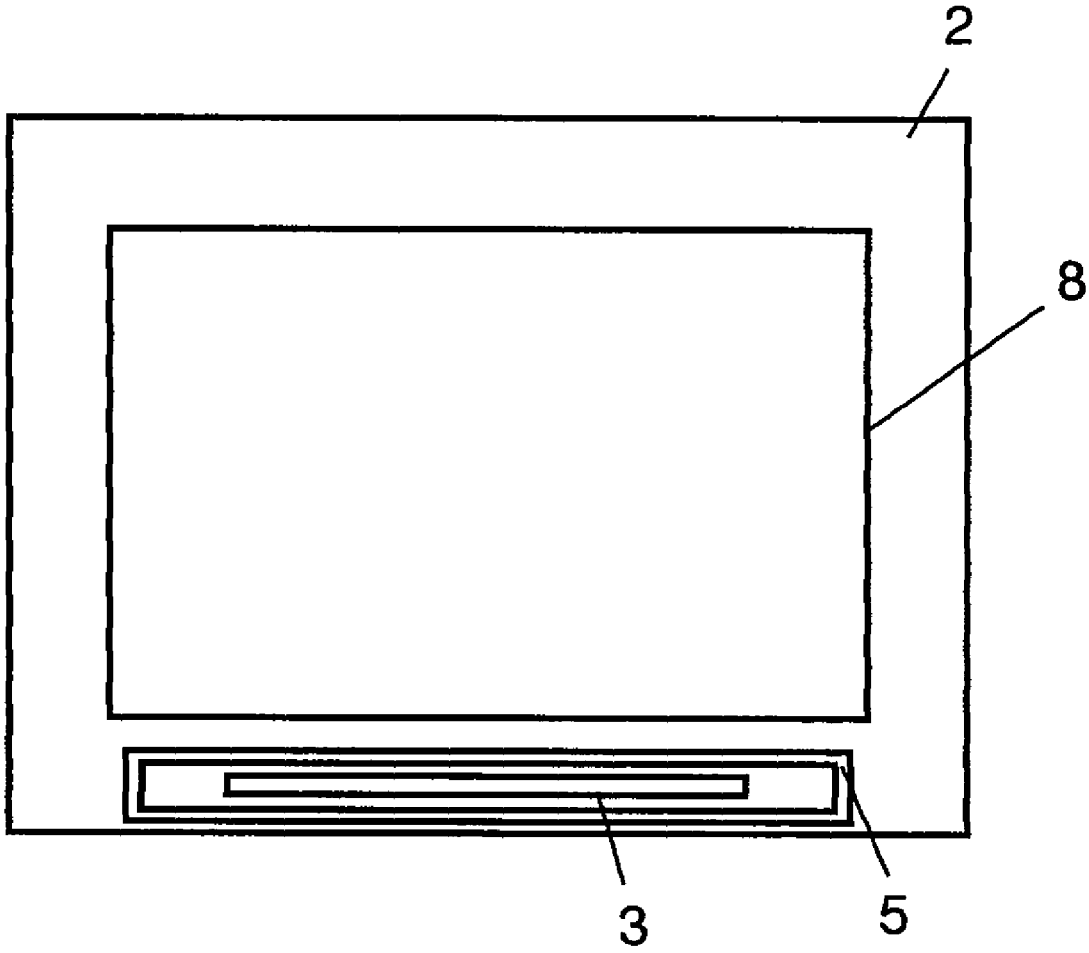
FIG. 13 is a plan view around an opening of a main body in still another structure of a microwave oven in the first exemplary embodiment of the present invention.

FIG. 13 is a plan view around an opening of a main body in still another structure of a microwave oven in this exemplary embodiment. The structure shown in FIG. 13 differs from that shown in FIG. 12 with respect to the shape and position of barrier 5. More specifically, reader 3 is provided around opening 8 of main body 1, and barrier 5 is provided so as to surround reader 3 and include the inner side of opening 8 with respect to reader 3. Also with this structure, barrier 5 shields reader 3 from electromagnetic waves emitted by magnetron 7 when door 2 is closed, and the shield for reader 3 is broken when door 2 is opened.

As shown in FIGS. 2, 5, 7, and 11, reader 3 is preferably provided near joint 12. The area near joint 12 is a part where object 9 to be heated always passes nearby while putting in and taking out object 9 to be heated. Installation of reader 3 in this position further ensures reliable reading of information in IC tag 10 by reader 3. Also in these drawings, joint 12 is provided under opening 8, and door 2 opens and closes vertically. However, the present invention is not limited to this structure. Joint 12 may be provided above opening 8, or at either the left or right side extending vertically.

If door 2 opens horizontally, object 9 to be heated is inserted into main body 1 from the side opposite door 2. For example, if joint 12 is provided along the left side of opening 8, the user opens door 2 with the left hand, and inserts object 9 to be heated into main body 1 with the right hand. In this case, reader 3 is preferably provided around opening 8 on a side opposing the side where joint 12 is provided. This allows object 9 to be heated, to which IC tag 10 is attached, to pass near reader 3, and reader 3 can thus reliably read information in IC tag 10.

Reader 3 is preferably installed near the center of door 2, as shown in FIGS. 2, 5, 7, and 11. More specifically, if main body 1 and door 2 are coupled by joint 12, reader 3 is preferably installed on door 2 around the center of a side nearest to joint 12. This results in providing reader 3 at a position furthest from wireless IC tags other than IC tag 10 attached to object 9 to be heated. Accordingly, erroneous reading of any unrelated wireless IC tag nearby is preventable.

Second Exemplary Embodiment

Figure 14:
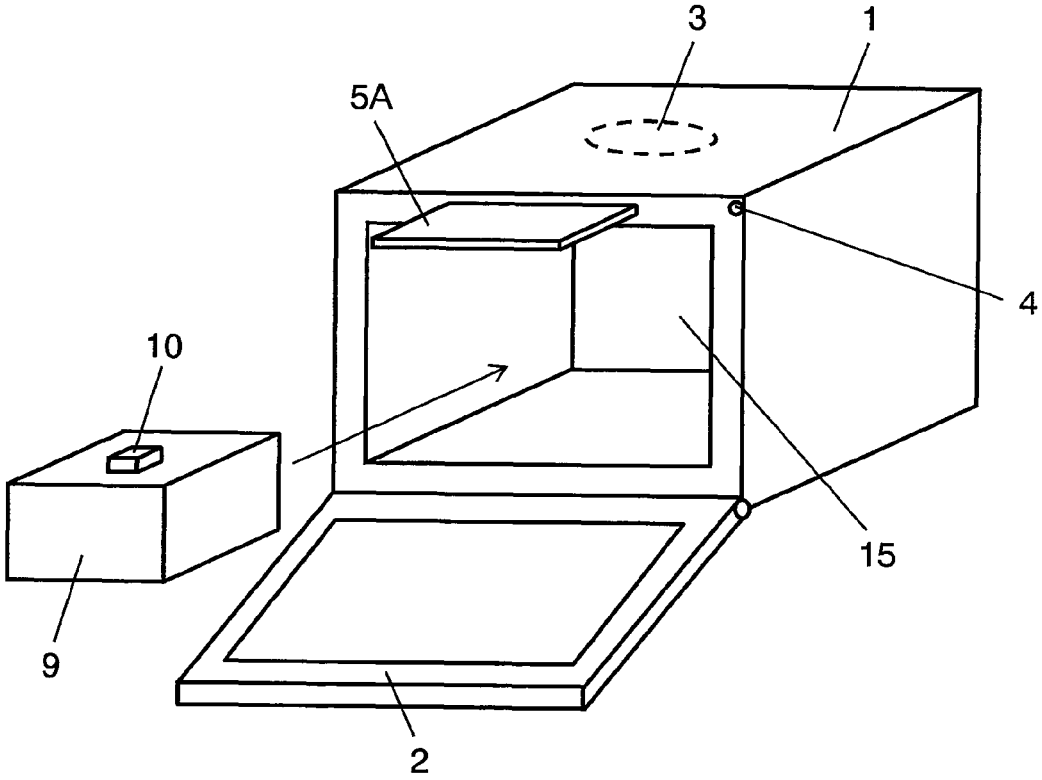
FIG. 14 is a perspective view of a microwave oven in accordance with a second exemplary embodiment of the present invention.
Figure 15:
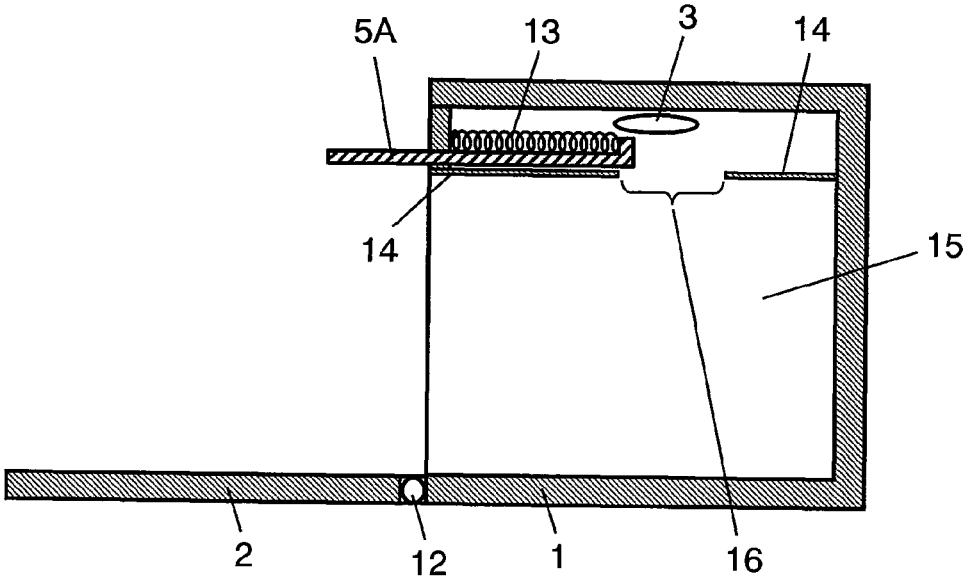
FIG. 15 is a sectional view of an open state of a door of the microwave oven shown in FIG. 14.
Figure 16:
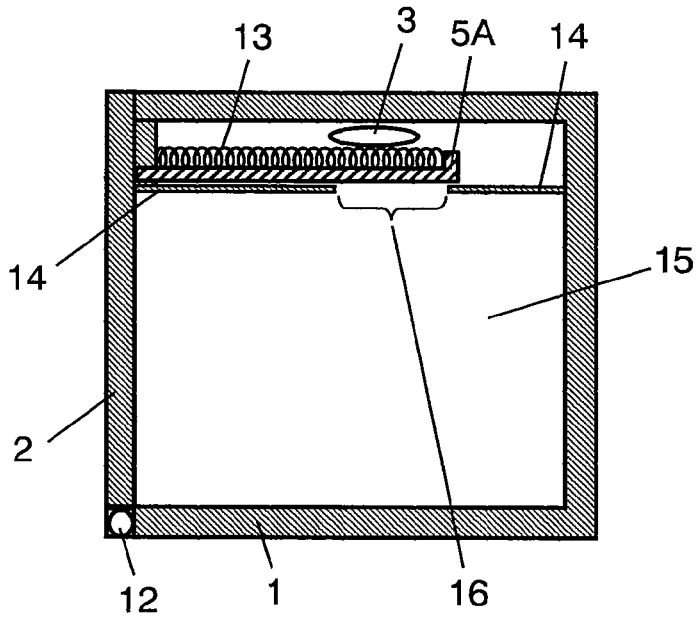
FIG. 16 is a sectional view of a closed state of the door of the microwave oven shown in FIG. 14.

FIG. 14 is a perspective view of a microwave oven which is a heating device in the second exemplary embodiment of the present invention. FIGS. 15 and 16 are sectional views of the microwave oven shown in FIG. 14 in the states the door is opened and closed, respectively. A functional block diagram is the same as FIG. 1 in the first exemplary embodiment. In other words, this exemplary embodiment differs from the first exemplary embodiment with respect to the position of the reader and the structure of the barrier. Other parts are configured the same as that of the first exemplary embodiment, and thus their detailed descriptions are omitted here.

In this exemplary embodiment, reader 3 is provided inside main body 1. More specifically, reader 3 is provided at a position isolated from cooking space 15 by partition plate 14 with window 16. Partition plate 14 blocks electromagnetic waves for heating.

Barrier 5A protrudes from main body 1 by the force of spring 13 when door 2 is opened, as shown in FIGS. 14 and 15. In this state, reader 3 is exposed to cooking space 15 through window 16, and thus communication with wireless IC tag (hereinafter "IC tag") 10 placed in cooking space 15 of main body 1 is feasible for reading information. On the other hand, as shown in FIG. 16, when door 2 is closed, barrier 5A is pushed by door 2, and spring 13 stretches. This makes barrier 5A move to a position where barrier 5A shields reader 3 from cooking space 15, completely covering window 16. In other words, barrier 5A moves inside main body 1 to a position where barrier 5A shields magnetron 7 from reader 3 when door 2 is closed. As a result, reader 3 is electromagnetically isolated from cooking space 15, and thus electromagnetic waves for heating are not emitted to reader 3, avoiding destruction of reader 3. Accordingly, door 2 and spring 13 move barrier 5A. In other words, door 2 itself configures a moving mechanism for moving barrier 5A to the electromagnetic-wave shielding position.

Barrier 5A is made of a substance with good conductivity, such as metal, or an insulating material such as resin on which typically a layer of conductive carbon or conductive resin is formed. Barrier 5A may also be made of punched metal, same as that used in door 2. The use of such materials for barrier 5A enables shielding of reader 3 from electromagnetic waves emitted by magnetron 7. Partition plate 14 is also preferably made of the same material as barrier 5A so as to further ensure protection of reader 3.

In FIGS. 14 to 16, reader 3 is disposed at the top part of main body 1. However, reader 3 is not limited to this position. Reader 3 may be disposed on one of the side faces or the bottom part. Window 16 is preferably provided at a position between an end near opening 8 and the center of main body 1 in a depth direction such that reader 3 can reliably read information in IC tag 10.

Figure 17:
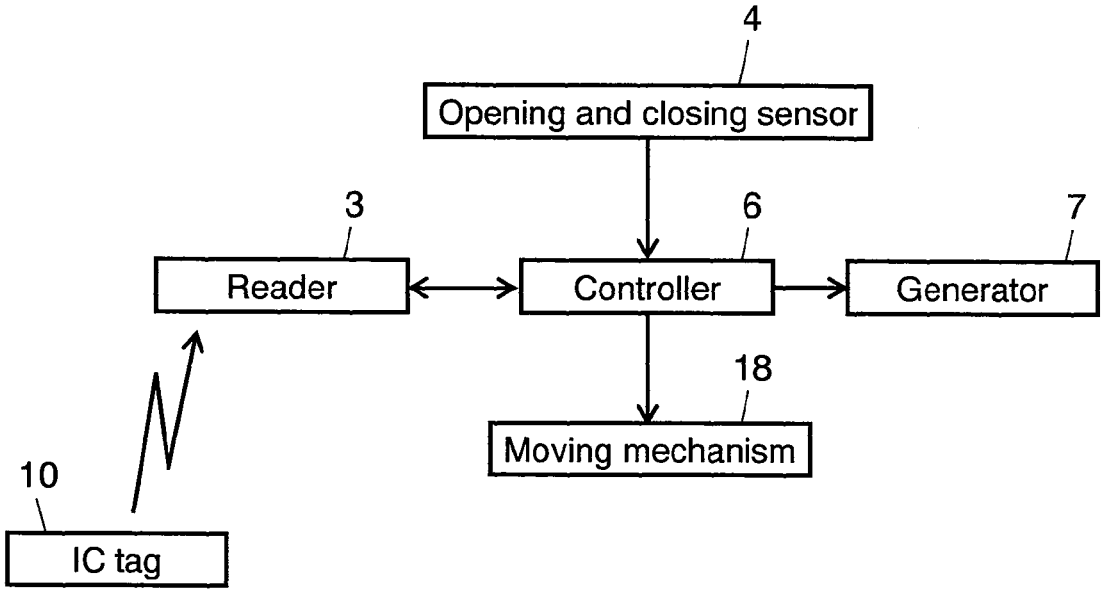
FIG. 17 is a functional block diagram of the microwave oven in the second exemplary embodiment of the present invention.

In this exemplary embodiment, barrier 5A is moved using door 2 and spring 13. In other words, door 2 itself configures the moving mechanism for moving barrier 5A. However, barrier 5A may be moved using other moving mechanisms. FIG. 17 shows a functional block diagram for another moving mechanism. In this structure, moving mechanism 18 for moving barrier 5A is added to the structure shown in FIG. 1.

Moving mechanism 18 is, for example, an actuator such as a motor for operating barrier 5A, which is provided on main body 1. Controller 6 controls moving mechanism 18 in accordance with an output of opening and closing sensor (hereinafter "sensor") 4, and operates barrier 5A. Moving mechanism 18 may also be configured with a gear which moves in conjunction with opening and closing of door 2.

Figure 18:
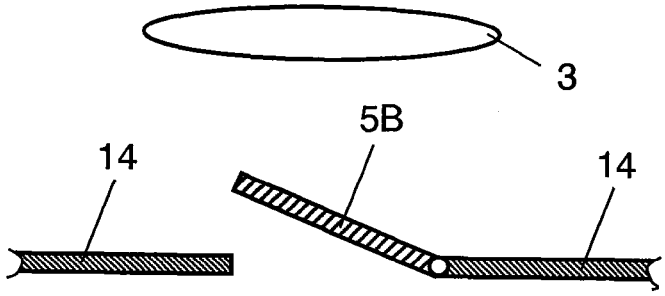
FIG. 18 is a sectional view of a key part of another structure of a barrier of a microwave oven in the second exemplary embodiment of the present invention.
Figure 19A:
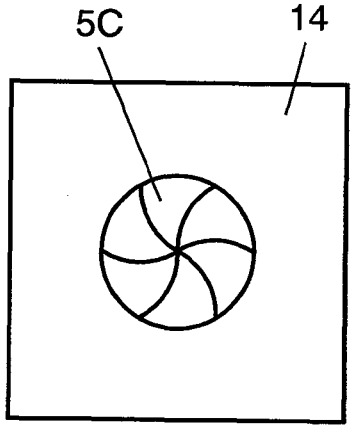
FIG. 19A is a plan view of a key part of still another structure of a barrier of a microwave oven in accordance with the second exemplary embodiment of the present invention.
Figure 19B:
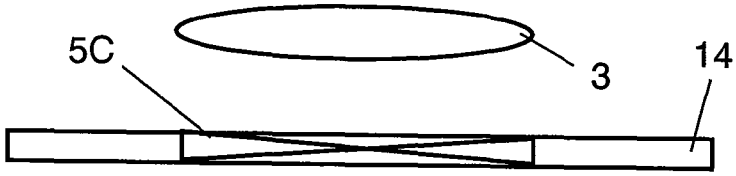
FIG. 19B is a sectional view of a key part of the still another structure of the barrier shown in FIG. 19A.

FIG. 15 shows sliding barrier 5A. However, the present invention is not limited to this type. For example, folding barrier 5B shown in a sectional view of FIG. 18 is also applicable. Still further, barrier 5C configured with a rotary sliding hatch, as shown in a plan view of FIG. 19A, is also applicable. FIG. 19B is a sectional view illustrating around reader 3 when barrier 5C is employed. Barriers 5B and 5C are driven by moving mechanism 18.

In the above exemplary embodiments, controller 6 preferably supplies power to reader 3 only when door 2 is opened by detecting whether door 2 is opened or closed using opening and closing sensor 4. This enables the operation of reader 3 only when it is needed. Accordingly, there is no need to activate reader 3 all the time, thus reducing energy consumption.

These exemplary embodiments are described taking microwave ovens as examples of heating devices. However, the present invention is not limited to microwave ovens. The object to be heated is also not limited to food. The present invention applies to any heating device, even heating devices for chemical experiments, provided an object is heated with electromagnetic waves. The exemplary embodiments described herein are therefore illustrative and not restrictive.

INDUSTRIAL APPLICABILITY

In the heating device of the present invention, the reader reads information in a wireless IC tag when the door is opened. On the other hand, the barrier protects the reader when the door is closed. This enables the reader to read the information in the wireless IC tag while eliminating any risk of electromagnetic waves for cooking destroying the reader. Accordingly, a user-friendly and highly reliable heating device is achievable.

The invention claimed is:

1. A heating device comprising:

a main body provided with an opening and defining a cooking space;

a magnetron configured to generate an electromagnetic wave for heating, the magnetron emitting the electromagnetic wave into the cooking space;

a door configured to cover the opening;

a reader configured to read information contained in a wireless IC tag attached to an object to be heated, the reader being provided on one of an inside surface of the door and a surface of the main body surrounding the opening of the main body, wherein the surface of the main body faces the inside surface of the door when the door is closed, such that the reader is not disposed within the cooking space when the door is closed; and a barrier positioned to act as a shield preventing the electromagnetic wave emitted by the magnetron from reaching the reader when the door is closed, and positioned to break the shield when the door is opened, the barrier being provided on at least one of the inside surface of the door and the surface of the main body surrounding the opening of the main body, such that the barrier is disposed between the reader and the cooking space when the door is closed.

2. The heating device according to claim 1, wherein the reader and the barrier are provided on the inside surface of the door.

3. The heating device according to claim 1, wherein the reader is provided on the door, and the barrier is provided on the main body.

4. The heating device according to claim 1, wherein the reader is provided on the main body, and the barrier is provided on the door.

5. The heating device according to claim 4, wherein the reader is provided surrounding the opening.

6. The heating device according to claim 1, wherein the reader and the barrier are provided on the main body.

7. The heating device according to claim 6, wherein the reader is provided surrounding the opening.

8. The heating device according to claim 1, further comprising an attachment configured to prevent disturbance of communication between the reader and the wireless IC tag by the placement area when the placement area is made of metal, the attachment being provided between the reader and the placement area.

9. The heating device according to claim 1, further comprising a joint configured to couple the door and the main body, wherein the reader is provided near the joint.

10. The heating device according to claim 1, further comprising a moving mechanism configured to move the barrier to a position to shield the reader from the magnetron in the main body when the door is closed.

11. The heating device according to claim 1, further comprising:

an opening and closing sensor configured to detect opening and closing of the door, and a controller configured to supply power to the reader only when the door is opened.

12. The heating device according to claim 1, wherein the barrier is configured to surround the opening of the main body when the door is closed, so that the barrier prevents the electromagnetic wave generated by the magnetron from leaking to outside of the heating device.

* * * * *